US005535465A

United States Patent [19]

Hannant

[11] Patent Number: 5,535,465

[45] Date of Patent: Jul. 16, 1996

[54] TROLLEYS

[75] Inventor: Keith Hannant, Rustington, England

[73] Assignee: Smiths Industries Public Limited Company, London, England

[21] Appl. No.: 390,504

[22] Filed: Feb. 17, 1995

[30] Foreign Application Priority Data

Mar. 1, 1994 [GB] United Kingdom ..... 9403848

[51] Int. Cl.[6] ..... A61G 7/012; A61G 13/00

[52] U.S. Cl. ..... 5/611; 5/620; 280/43.23

[58] Field of Search ..... 5/611, 600, 620, 5/86.1, 81.1; 280/43.23

[56] References Cited

U.S. PATENT DOCUMENTS 5,220,698 6/1993 Hannant ..... 5/611

FOREIGN PATENT DOCUMENTS 2242624 10/1991 United Kingdom ..... 5/611

2277870 11/1994 United Kingdom ..... 5/86.1

*Primary Examiner*—Alexander Grosz

*Attorney, Agent, or Firm*—Pollock, Vande Sande & Priddy

[57] ABSTRACT

A patient trolley has a top that can be raised and lowered hydraulically. A guide wheel mounted on a resilient suspension is coupled to the trolley top so that, when the top is raised, the guide wheel is also raised and, when the top is lowered, the guide wheel is lowered into contact with the floor.

5 Claims, 1 Drawing Sheet

TROLLEYS

BACKGROUND OF THE INVENTION

This invention relates to trolleys.

The invention is more particularly concerned with trolleys for use in transporting patients, such as to and from a surgical operating table.

Conventional patient trolleys are supported on the floor on castors so that the trolley can be moved in all directions. It can also be useful for the trolley to have a guide wheel that can be brought into engagement with the floor when desired so that movement of the trolley is confined to one direction. The guide wheel can be lowered manually or hydraulically. Examples of trolleys are described in GB2277870. Similar arrangements are also used in surgical operating tables. In GB2242624 there is described a table supported on castors and having a guide wheel brought into contact with the floor when hydraulic pressure is applied to raise the table top. When further hydraulic pressure is applied, a base plate is lowered to the floor to brake movement of the table. Such an arrangement is not suitable for trolleys because it is often necessary to be able to manoeuvre the trolley when the trolley top is at an elevated height.

BRIEF SUMMARY OF THE INVENTION

It is an object of the present invention to provide an improved form of trolley.

According to the present invention there is provided a trolley having a base assembly including a plurality of castors arranged to contact the floor and support the trolley, a trolley top, means for raising and lowering the trolley top with respect to the base assembly, and a guide wheel, the guide wheel being arranged to be lowered into contact with the floor when the trolley top is lowered and to be raised out of contact with the floor when the trolley top is raised.

The guide wheel is preferably coupled with the table top so that it is raised or lowered with the trolley top. The means for raising and lowering the trolley top may include hydraulic means. The guide wheel is preferably mounted on a resilient suspension.

A patient transfer trolley in accordance with the present invention, will now be described, by way of example, with reference to the accompanying drawings.

DETAILED DESCRIPTION OF THE PREFERRED EMBODIMENT

Figure 1:
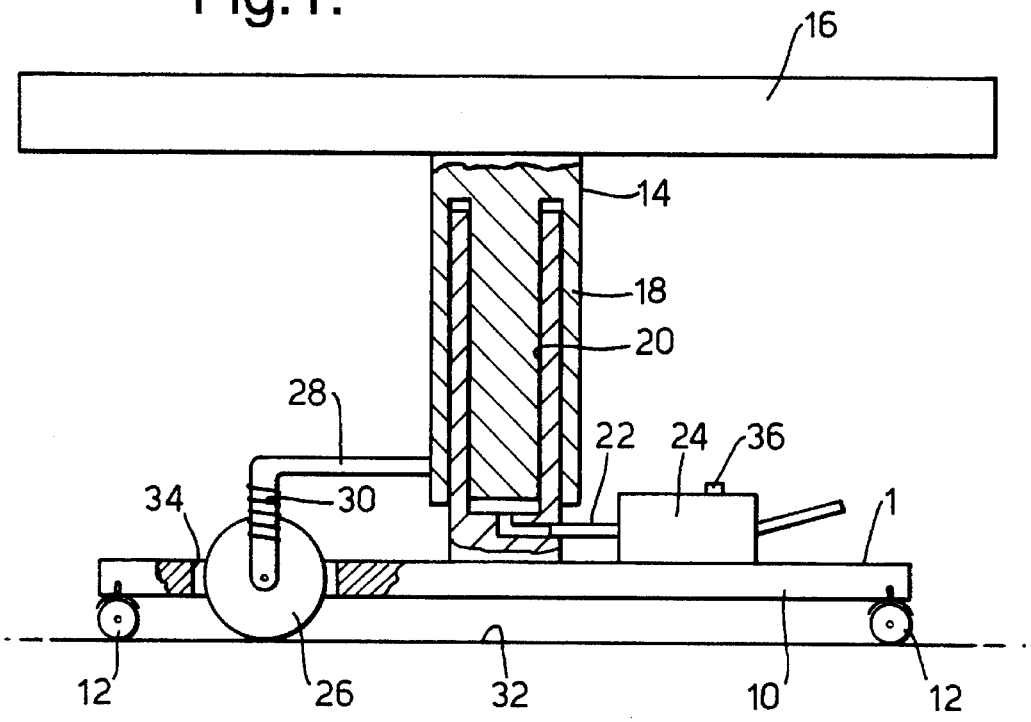
FIG. 1 is a simplified side elevation view of the trolley with its top in a lowered position.

With reference first to FIG. 1, the trolley has a base assembly 1 comprising a flat, rectangular base plate 10 and four castors 12, one at each corner. The castors 12 are rotatable about their horizontal and vertical axes. An hydraulic support column 14 projects vertically from the base plate 10 and supports, at its upper end, the trolley top 16. The trolley top 16 serves to support the patient and may be detachable from the trolley in the manner described in GB2277870. The column 14 has an outer cylindrical housing 18 connected to the top 16, and an inner cylinder 20 connected via a hydraulic fluid line 22 to a foot-operated hydraulic pump 24 by which the user can alter the height of the trolley top. Alternatively, an electrically-operated pump could be used. In the position shown, the column 14 is fully retracted and the trolley top 16 is at its lowest elevation.

The trolley also includes a guide wheel 26 mounted on an arm 28 projecting from one side of the outer housing 18 of the column 14. The arm 28 includes a resilient suspension 30 for the guide wheel 26. The guide wheel 26 contacts the floor 32 through an opening 34 in the base plate 10 and supports a part of the weight of the trolley via its suspension 30. The guide wheel 26 is rotatable about a horizontal axis extending transversely of the axis of the trolley and, in this position, the guide wheel confines movement of the trolley to a straight line along the axis of the trolley.

Figure 2:
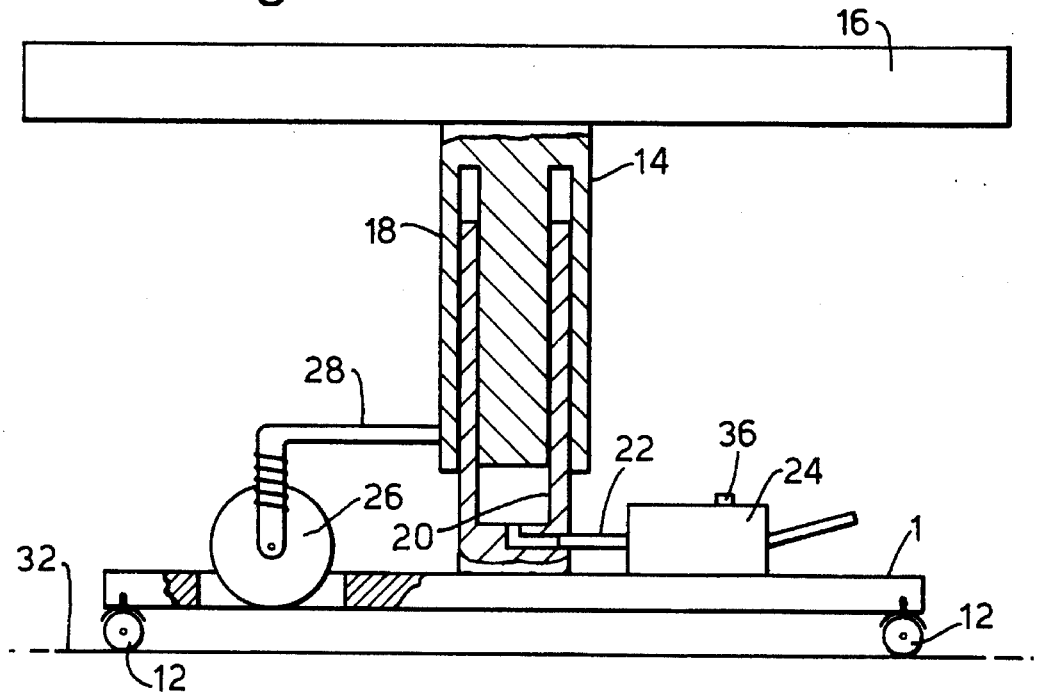
FIG. 2 is a simplified side elevation view of the trolley of FIG. 1 with its top in an elevated position.

The height of the trolley top 16 can be raised by pumping the foot pump 24 to supply fluid to the cylinder 20 in the column 14, thereby extending the column and increasing the height of the top. As the column 14 extends, the housing 18 rises and, along with it, the arm 28 and the guide wheel 26. The guide wheel 26 is, therefore, automatically raised with the trolley top. When the guide wheel 26 is clear of the floor 32 it no longer confines movement of the trolley, which is now supported entirely by the castors 12, as shown in FIG. 2. In this elevated position, therefore, the trolley can be manoeuvred freely in any direction. Free movement of the trolley on its castors 12 is possible when a patient is being transferred to or from a surgical operating table because the trolley will be in an elevated state to match the height of the table. If the user wishes to bring the guide wheel 26 into contact with the floor 32 again, such as when wheeling the trolley along a straight corridor, he simply releases pressure in the column 14 by means of a release button 36 on the pump 24. This allows the trolley top 16 to lower to the position shown in FIG. 1 and automatically allows the guide wheel 26 to resume its initial position.

The present invention enables the guide wheel to be raised and lowered in a very simple way without the need for additional controls.

Instead of coupling the guide wheel 26 to the trolley top 16 it would be possible to mount the guide wheel on the base assembly 1 by means of its own hydraulic cylinder that also receives fluid pressure from the same pump 24, so that the guide wheel is again raised or lowered automatically with the trolley top. It will be appreciated that the present invention is not confined to patient trolleys but could be used with trolleys for other purposes.

What I claim is:

1. A trolley comprising a base assembly, the base assembly including a plurality of castors arranged to contact the floor and support the trolley; a trolley top adapted to support a patient; a mechanism for raising and lowering the trolley top with respect to the base assembly; and a guide wheel, wherein the guide wheel is lowered into contact with the floor when the trolley top is lowered and is raised out of contact with the floor when the trolley top is raised.

2. A trolley according to claim 1, including a structure coupling the guide wheel to the trolley top so that it is raised or lowered with the trolley top.

3. A trolley according to claim 1, wherein the mechanism for raising and lowering the trolley top is a hydraulic mechanism.

4. A trolley according to claim 1, including a resilient suspension and wherein the guide wheel is mounted on the resilient suspension.

5. A trolley comprising a base assembly, the base assembly including a plurality of castors arranged to contact the floor and support the trolley; a trolley top adapted to support a patient; a hydraulic mechanism for raising and lowering the trolley top with respect to the base assembly; a guide wheel, and a structure coupling the guide wheel to the trolley top so that the guide wheel is lowered or raised by said hydraulic mechanism when the trolley top is lowered or raised respectively.

* * * * *